US008915640B2

(12) United States Patent
Park et al.

(10) Patent No.: US 8,915,640 B2
(45) Date of Patent: Dec. 23, 2014

(54) DISPLAY DEVICE

(71) Applicant: Electronics and Telecommunications Research Institute, Daejeon (KR)

(72) Inventors: Suntak Park, Daejeon (KR); Seung Koo Park, Daejeon (KR); Min-Su Kim, Daejeon (KR); Ki Uk Kyung, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 23 days.

(21) Appl. No.: 13/649,387

(22) Filed: Oct. 11, 2012

(65) Prior Publication Data

US 2013/0182455 A1 Jul. 18, 2013

(30) Foreign Application Priority Data

Jan. 18, 2012 (KR) ..... 10-2012-005629

(51) Int. Cl.
*F21V 7/04* (2006.01)

(52) U.S. Cl.
USPC ..... 362/616; 362/23.16; 362/559; 362/602; 40/546

(58) Field of Classification Search
USPC ..... 362/23.01, 23.16, 92, 223, 244, 249.01, 362/249.02, 331, 540, 543, 553–556, 559, 362/615, 616, 602, 604, 800; 40/541, 542, 40/546, 547, 562, 563; 340/815.42, 340/518.45
See application file for complete search history.

(56) References Cited

U.S. PATENT DOCUMENTS

| | | | | |
|---|---|---|---|---|
| 4,206,495 | A * | 6/1980 | McCaslin | 362/551 |
| 5,151,679 | A * | 9/1992 | Dimmick | 340/326 |
| 5,483,427 | A * | 1/1996 | Dealey et al. | 362/485 |
| 5,573,327 | A * | 11/1996 | Dealey et al. | 362/485 |
| 6,443,582 | B1 * | 9/2002 | Tarne et al. | 362/27 |
| 7,186,015 | B2 * | 3/2007 | Kimmet et al. | 362/630 |
| 7,407,303 | B2 * | 8/2008 | Wanninger et al. | 362/227 |
| 7,534,013 | B1 * | 5/2009 | Simon | 362/335 |
| 7,549,783 | B2 * | 6/2009 | Cassarly et al. | 362/559 |
| 7,635,214 | B2 * | 12/2009 | Perlo | 362/559 |
| 8,064,743 | B2 * | 11/2011 | Meir et al. | 385/31 |
| 8,534,890 | B2 * | 9/2013 | Goto et al. | 362/551 |
| 2002/0018350 | A1 * | 2/2002 | Lepley et al. | 362/551 |
| 2004/0032747 | A1 * | 2/2004 | Currie et al. | 362/551 |
| 2004/0120152 | A1 * | 6/2004 | Bolta et al. | 362/294 |
| 2005/0083673 | A1 * | 4/2005 | Braun | 362/31 |

(Continued)

FOREIGN PATENT DOCUMENTS

| | | | |
|---|---|---|---|
| JP | 2002-072333 | A | 3/2002 |
| KR | 10-2002-0094846 | A | 12/2002 |
| KR | 10-1050252 | B1 | 7/2011 |

*Primary Examiner* — Hargobind S Sawhney
(74) *Attorney, Agent, or Firm* — Rabin & Berdo, P.C.

(57) ABSTRACT

Disclosed is a display device including a plurality of channels for forming a specific pattern, in which each of the channels includes: a light source module comprising one or more light sources for generating optical signals having different wavelengths; a driving module for controlling on/off or strength of the optical signal generated in the light source module; an optical waveguide for transferring the optical signal generated in the light source module to an outside without a loss of the optical signal; and a scattering pattern for scattering the optical signal transferred through the optical waveguide and displaying the scattered optical signal to the outside.

8 Claims, 8 Drawing Sheets

(56) References Cited

U.S. PATENT DOCUMENTS

| | | | | |
|---|---|---|---|---|
| 2006/0114684 | A1* | 6/2006 | Marquez | 362/487 |
| 2007/0209254 | A1* | 9/2007 | Perlo | 40/541 |
| 2007/0283636 | A1* | 12/2007 | Bernacki et al. | 52/173.2 |
| 2008/0074752 | A1* | 3/2008 | Chaves et al. | 359/641 |
| 2009/0100727 | A1 | 4/2009 | Chen | |
| 2009/0201675 | A1* | 8/2009 | Onishi et al. | 362/223 |
| 2009/0219730 | A1* | 9/2009 | Syfert et al. | 362/489 |
| 2011/0075441 | A1* | 3/2011 | Swessel et al. | 362/554 |

* cited by examiner

DISPLAY DEVICE

CROSS-REFERENCE TO RELATED APPLICATIONS

This application is based on and claims priority from Korean Patent Application No. 10-2012-0005629, filed on Jan. 18, 2012, with the Korean Intellectual Property Office, the disclosure of which is incorporated herein in its entirety by reference.

TECHNICAL FIELD

The present disclosure relates to a display device, such as a signboard or a banner, and more particularly, to a display device which is very thin, can be rolled into a tube-shape, and is used in a dashboard, a watch, and a keyboard of a portable device in which a number or a character is changed, as well as an advertisement board, a direction board, a sign, and a sign display device, such as a wall for decoration, displaying a logo, characters, patterns, and numbers.

BACKGROUND

Generally, display devices for notifying information, such as a telephone number, a price, a pattern, and a phrase, include a signboard, a banner, a sign, and the like. Most of the display devices use an optical method in order to improve day and night visibility. Especially, display devices having various structures using an LED have been recently suggested, and an advertising effect has been obtained through a new function of the display device.

A representative display device among the display devices using the LED includes a display device using a light guide pad, in which an advertisement phrase or a design is imprinted on a surface of the light guide pad, LED devices as light sources are mounted to a side cross-section to emit light, and the characters or the advertisement phrase or design are displayed to the outside by using the light. The light guide pad in the conventional display device is generally made of a transparent acryl material and has a flat panel-type main body. The aforementioned light guide pad using the acryl has excellent light transmission performance, so that the light is distributed and scattered in the pattern, such as the character or the design, while being incident to and guided in an inside of an acryl panel by the LED devices constituting the light sources, so as to display the corresponding character or advertisement phrase to the outside, thereby achieving an advertising effect.

However, since the conventional display device uses a planar light guide pad, all characters and designs imprinted on the light guide pad are simultaneously turned on/off according to the turning on/off of the light source, and the character or the design cannot be individually turned on/off, so that the change of the character, or the like, is impossible. Further, the conventional display device uses a thick and hard acryl panel as the light guide pad, so that there is a disadvantage in that the display device cannot be bent. Accordingly, the disadvantage causes the deterioration of applicability of the conventional display device to various fields, such as the signboard or the banner, using the light.

SUMMARY

The present disclosure has been made in an effort to provide an optical waveguide-based display device, which not only can be rolled into a tube-shape, beyond a bent characteristic, but also can transform respective characters.

An exemplary embodiment of the present disclosure provides a display device including: a plurality of channels for forming a specific pattern, in which each of the channels includes: a light source module including one or more light sources for generating optical signals having different wavelengths; a driving module for controlling on/off or strength of the optical signal generated in the light source module; an optical waveguide for transferring the optical signal generated in the light source module to an outside without a loss of the optical signal; and a scattering pattern for scattering the optical signal transferred through the optical waveguide and displaying the scattered optical signal to the outside.

Accordingly, the aforementioned present disclosure provides the display device capable of expressing a number, a character or a pattern, such as a design, desired to be expressed on a very thin and flexible film-type substrate, so that the display device may be stored and perform a display in a rolled form, may be installed on a wall or a pillar having a curved surface, etc., and may be used in a place, such as a clock and a dashboard, in which a change of a number is needed through the change of the pattern.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

A display device according to the present disclosure may be rolled into a tube-shape by using a thin film-type panel unit including an embedded optical waveguide and scattering pattern, instead of a light guide pad in the form of the planar waveguide used in the conventional art. Further, in the display device according to the present disclosure, one scattering pattern is formed for each optical waveguide, and characters or numbers are implemented through a combination of the scattering patterns.

Hereinafter, exemplary embodiments of the present disclosure will be described in detail with reference to the accompanying drawings. In describing the present disclosure, a detailed description of related known configurations and functions will be omitted when it may make the essence of the present disclosure obscure.

Figure 1:
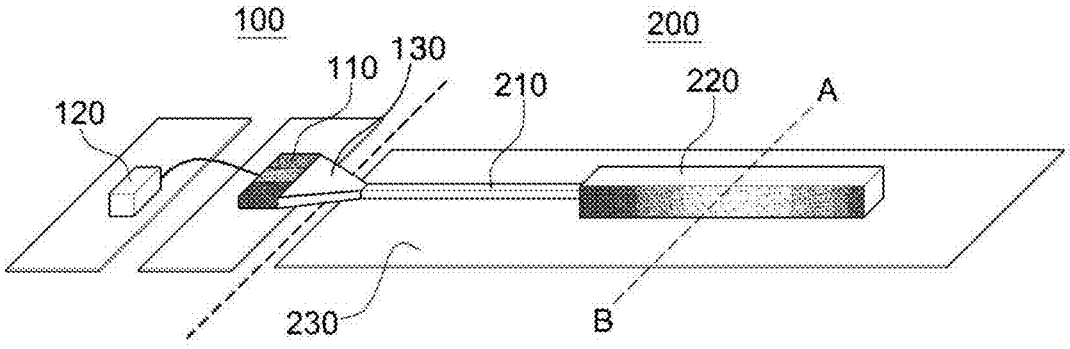
FIG. 1 is a conceptual diagram illustrating a basic structure of a display device according to an exemplary embodiment of the present disclosure.
Figure 2:
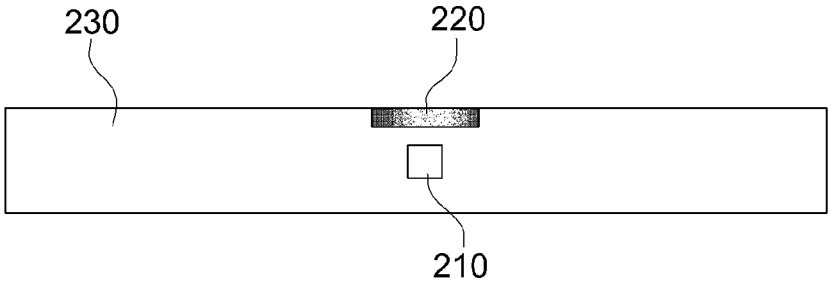
FIG. 2 is a cross-sectional view illustrating the display device taken along line A-B of FIG. 1.

FIG. 1 is a diagram illustrating a basic structure of the display device according to an exemplary embodiment of the present disclosure, and FIG. 2 is a cross-sectional view illustrating the display device taken along line A-B of FIG. 1.

Referring to FIGS. 1 and 2, the display device according to the present disclosure is generally divided into a light source unit 100 and a panel unit 200.

The light source unit 100 includes a light source module 110 and a driving module 120.

The light source module 110 includes one or more light sources for generating optical signals having different wavelengths. Here, the light source module 110 may be an LD, an LED and a lamp emitting a white light.

The driving module 120 controls on/off or strength of the optical signal generated in the light source module 110. To this end, the driving module 120 may include an electrical device for supplying a current to the light source module 110 or controlling strength of the current, and an electrical PCB including the electrical device and a circuit.

Further, the light source unit 100 may further include an input means 130 for inputting the optical signal generated in the light source module 110 to an optical waveguide 210 to be described later. Here, the input means 130 may be an optical coupler for mixing the optical signals having different wavelengths generated in the light source module 110.

The panel unit 200 is formed of a flexible film 230 including the optical waveguide 210 and a scattering pattern 220. Here, an acryl substrate or a glass substrate may be used instead of the flexible film 230.

The optical waveguide 210 transfers the optical signal generated in the light source module 110 to the scattering pattern 220 without a loss of the optical signal to the outside. Here, the optical waveguide 210 is formed of a material having a higher optical refractive index than that of the flexible film 230 so as to prevent the optical signal from escaping from the optical waveguide. Further, a cross-section of the optical waveguide 210 may be formed in various shapes, such as a circle, an ellipse, and a leaf, as illustrated in FIG. 2 depending on a condition of a process and a material.

The scattering pattern 220 outputs the optical signal transferred through the optical waveguide 210 to the outside of the flexible film 230, so that a person can view the optical signal. The scattering pattern 220 may be formed in an upper portion of the optical waveguide 210 as illustrated in FIG. 2, or be formed in a lower portion of the optical waveguide 210 or in the optical waveguide 210.

FIGS. 3A to 3D are diagrams illustrating an example of an implementation of a number in a display device according to an exemplary embodiment of the present disclosure.

Figure 3A:
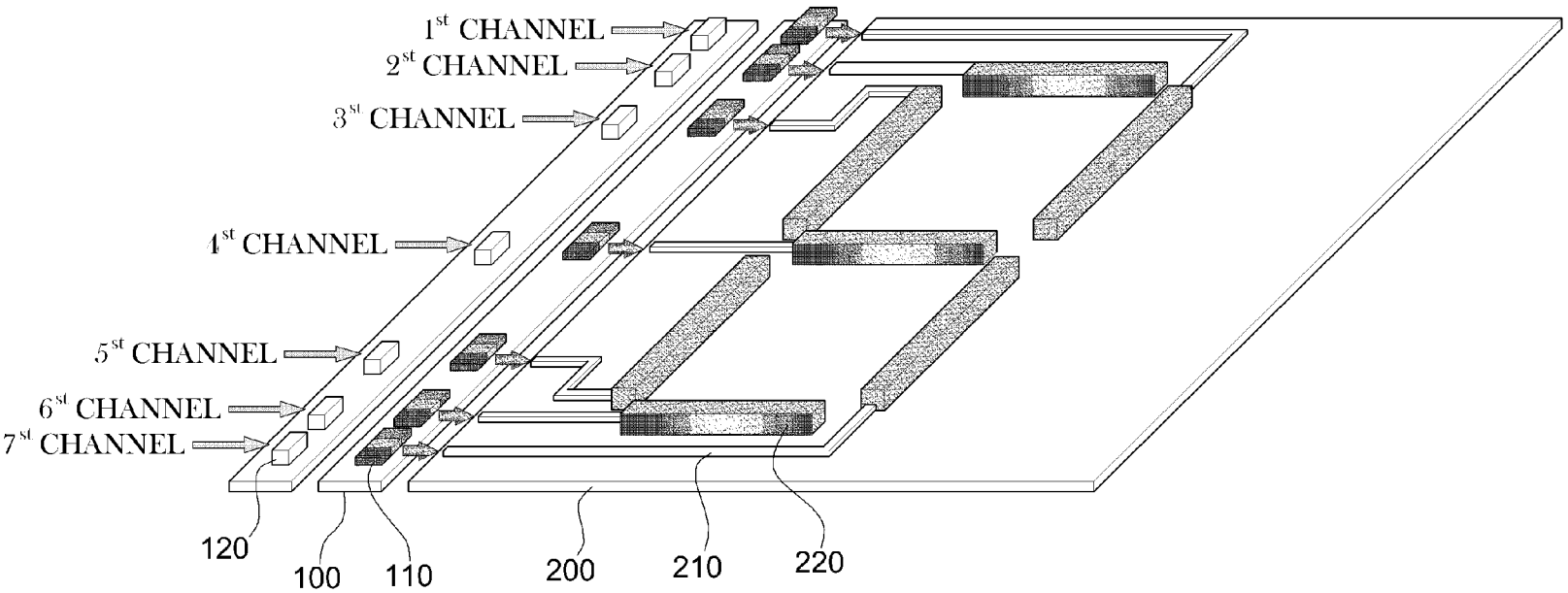
FIGS. 3A to 3D are diagrams illustrating an example of an implementation of a number in a display device according to an exemplary embodiment of the present disclosure.

As illustrated in FIG. 3A, the display device according to the present disclosure may include seven channels, i.e. a first channel to a seventh channel. In this case, the display device may implement a number "8" by turning on all of the light source modules 110 constituting the respective channels.

Figure 3B:
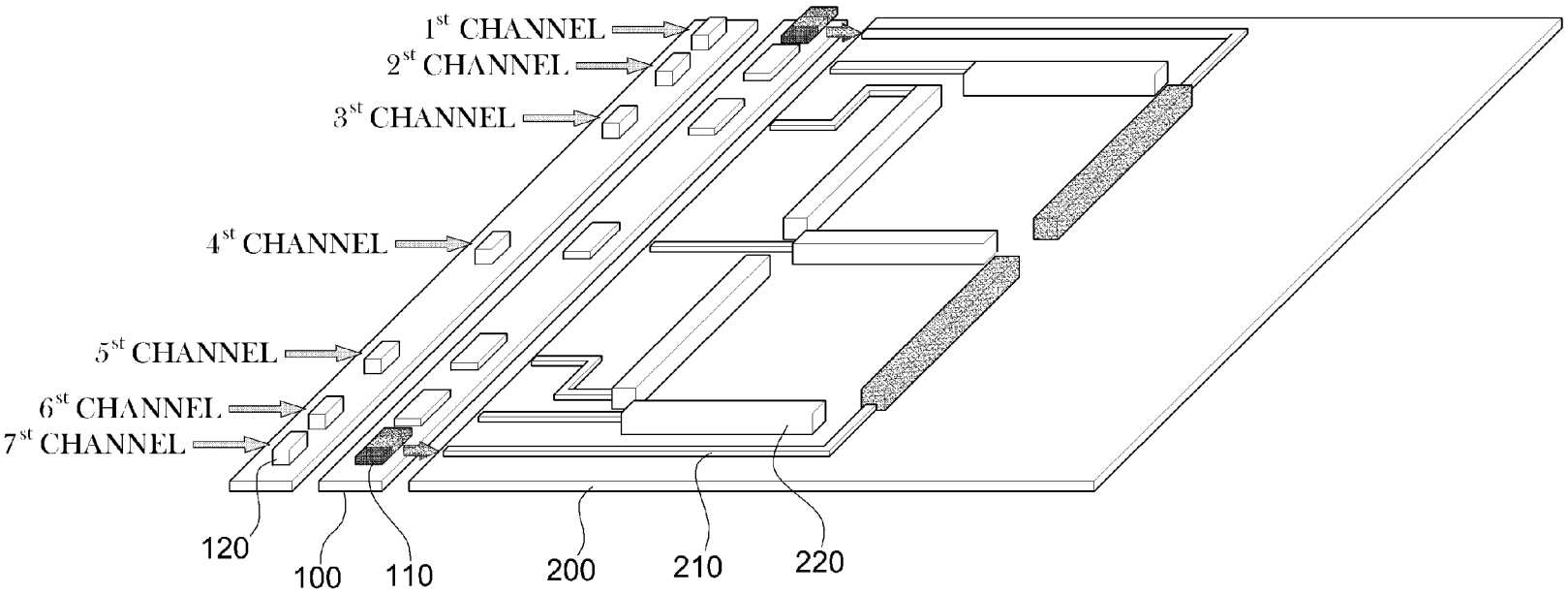

As illustrated in FIG. 3B, the display device according to the present disclosure may implement a number "1" by turning on only the first channel and the seventh channel.

Figure 3C:
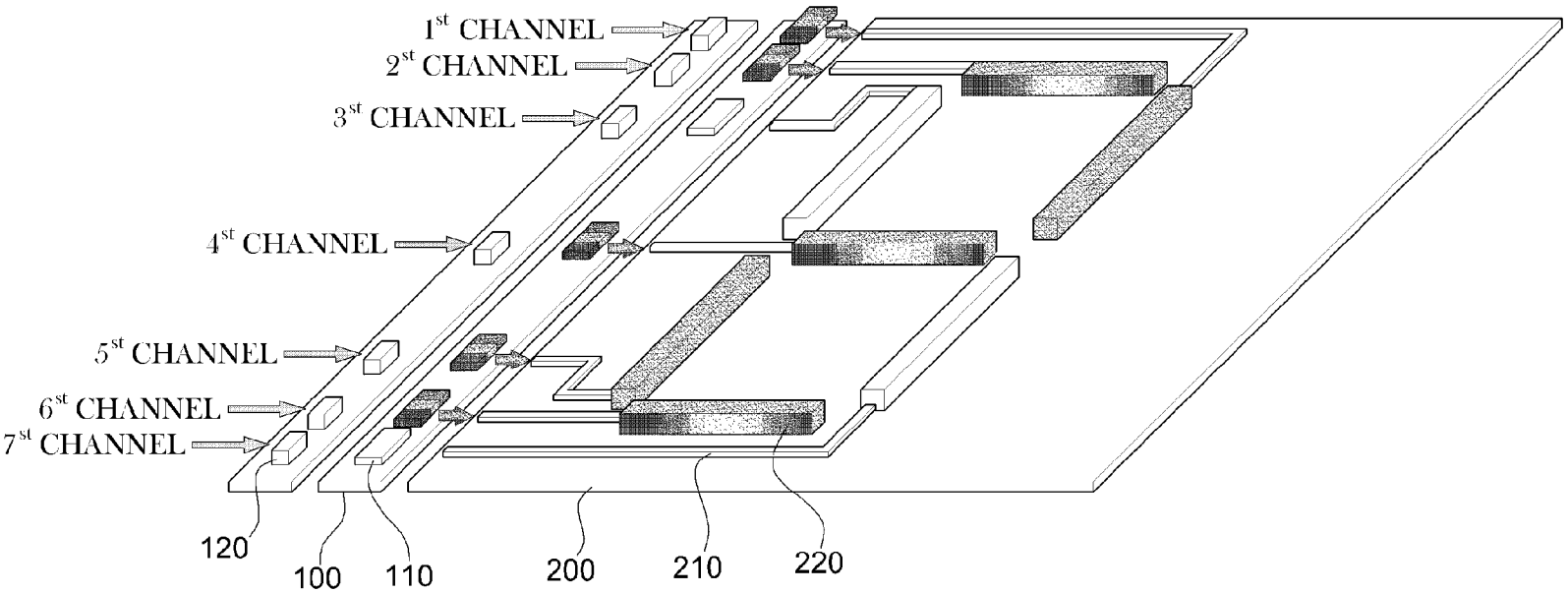

As illustrated in FIG. 3C, the display device according to the present disclosure may implement a number "2" by turning on the first channel, the second channel, the fourth channel, the fifth channel, and the sixth channel.

Figure 3D:
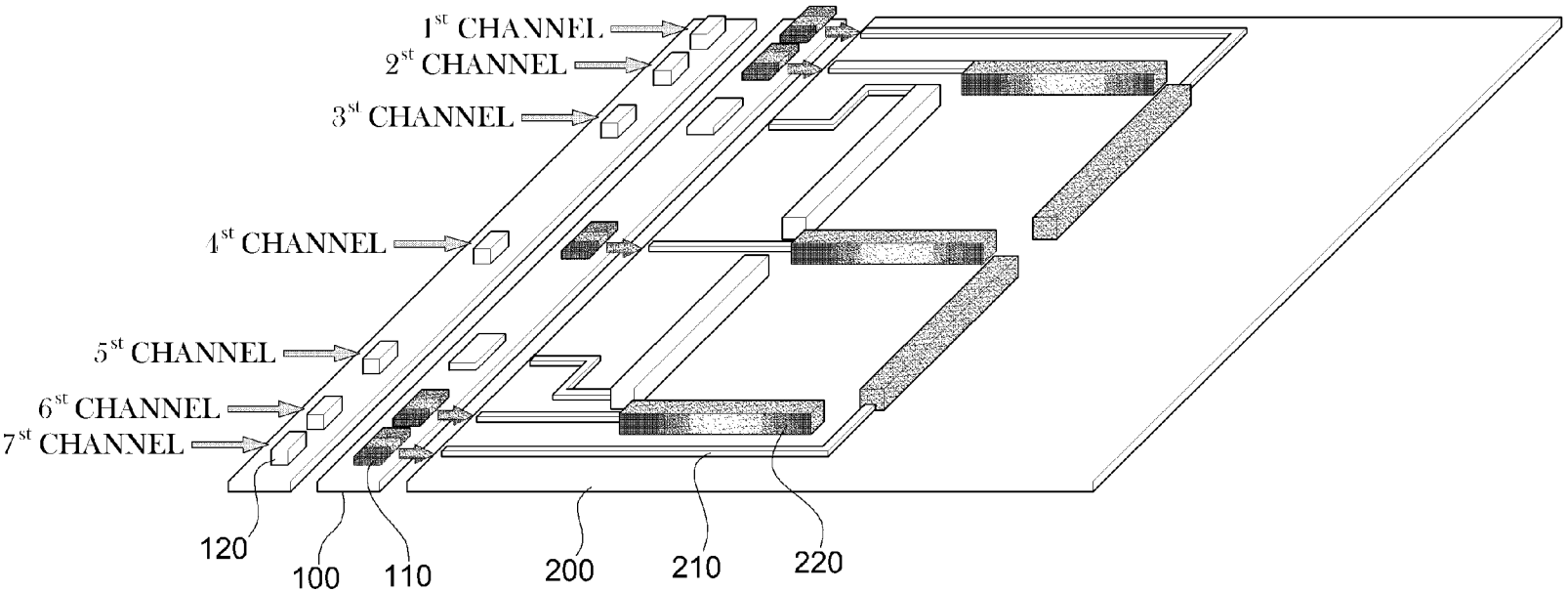

As illustrated in FIG. 3D, the display device according to the present disclosure may implement a number "3" by turning on the first channel, the second channel, the fourth channel, the sixth channel, and the seventh channel.

As described above, the display device according to the present disclosure may express various changing numbers or characters, as well as turning on/off the number or the character, through an array configuration shaped like a number "8". Accordingly, the display device according to the present disclosure may be used in a signboard, and the like, in which numbers, such as a time, a price, and a speed, need to be changed.

Figure 4:
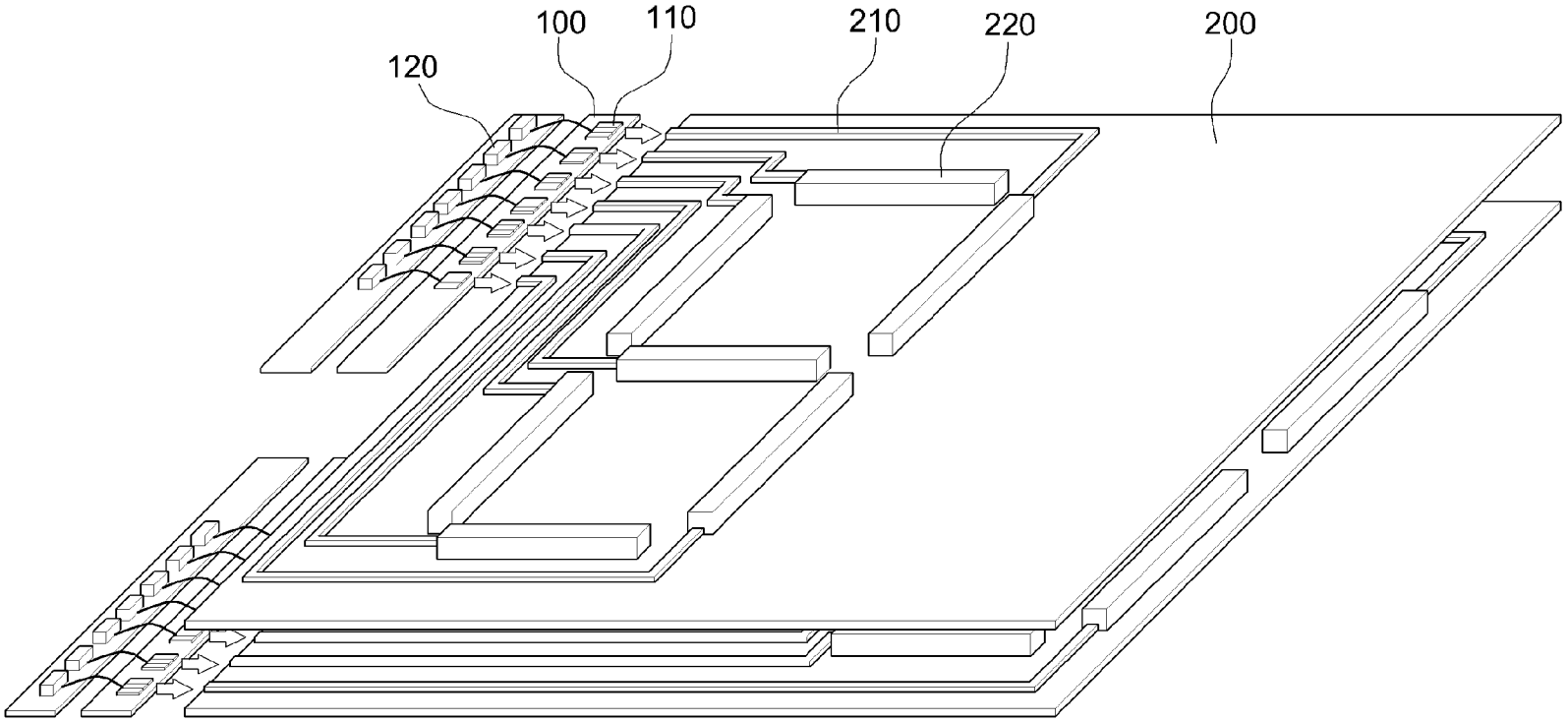
FIG. 4 is a diagram illustrating a configuration of a display device according to another exemplary embodiment of the present disclosure.

FIG. 4 is a diagram illustrating a configuration of a display device according to another exemplary embodiment of the present disclosure.

Referring to FIG. 4, the display device according to another exemplary embodiment of the present disclosure includes a two-layered structure, thereby achieving simplification and integration of a package and a driving unit and miniaturization of the panel unit 200. That is, the display device according to another exemplary embodiment of the present disclosure has the two-layered structure, so that even when the optical waveguides 210 pass while overlapping each other, interference between the optical waveguides 210 may be minimized.

Further, the display device according to another exemplary embodiment of the present disclosure may overlap and use the areas occupied by the optical waveguides 210 when expressing an array pattern, so that it is possible to minimize the area of the panel unit 200. To this end, the display device according to another exemplary embodiment of the present disclosure needs to use a transparent flexible film.

Figure 5:
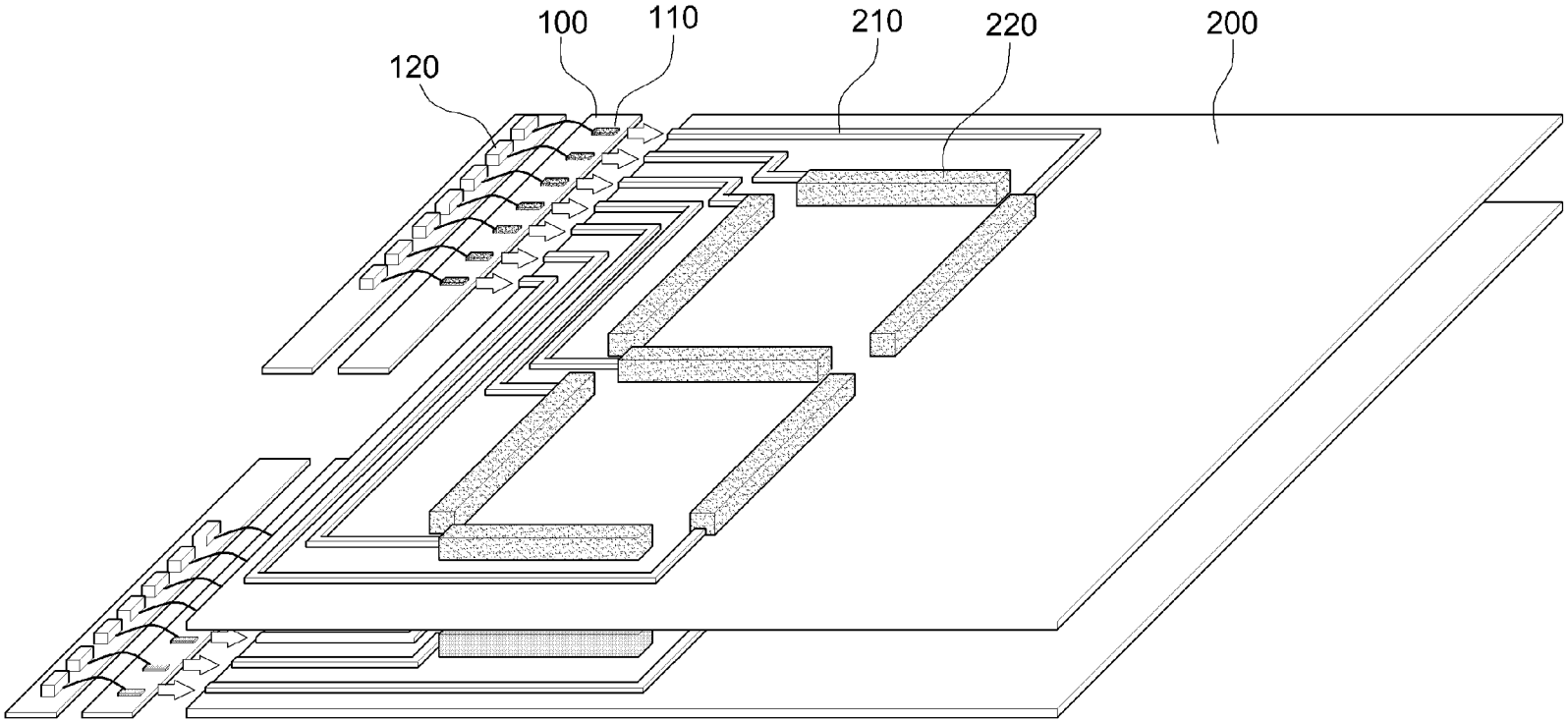
FIG. 5 is a diagram illustrating a configuration of a display device according to yet another exemplary embodiment of the present disclosure.

FIG. 5 is a diagram illustrating a configuration of a display device according to another exemplary embodiment of the present disclosure.

In the display device of FIG. 3, optical signals having three colors RGB are input in one optical waveguide, and a color of a number or a character desired to be expressed is represented by adjusting an intensity of a color of each optical signal. Therefore, the display device of FIG. 3 additionally needs an optical coupler in order to input the three colors in the one optical waveguide. In order to solve the aforementioned problem, a display device of FIG. 5 has been suggested.

Referring to FIG. 5, the display device according to yet another exemplary embodiment of the present disclosure is formed of multiple layers, like to the display device of FIG. 3, and the same pattern is formed on all of the multiple layers, so that the display device is viewed in one pattern when viewed from the top side.

However, the display device according to yet another exemplary embodiment of the present disclosure has a structure in which the light source module 120 having one color is formed in each layer, so that the one light source module 120 transfers the optical signal to the one optical waveguide 210 without the separate optical coupler. Accordingly, when the display device according to yet another exemplary embodiment of the present disclosure includes the light source modules of the three colors RGB in the three layers, the display device according to yet another exemplary embodiment of the present disclosure may express all colors identically to the display device of FIG. 3.

Further, in the display device according to another exemplary embodiment of the present disclosure, different patterns are formed in the respective layers, and the respective patterns may be differently expressed for each color.

The exemplary embodiments disclosed in the specification of the present disclosure will not limit the present disclosure. The scope of the present disclosure will be construed by the claims below, and it will be construed that all techniques within the scope equivalent thereto belong to the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A display device, comprising:

a plurality of channels, each of the channels including:

a light source module configured to generate optical signals having different wavelengths;

a driving module in electrical connection with the light source, the driving module being configured to control the generation of the optical signals in the light source module and the strength of the generated optical signals;

an optical waveguide configured to transfer the generated optical signals from the light source module; and a scattering pattern configured to scatter the optical signals transferred thereto from the light source module through the optical waveguide, wherein the optical waveguide and the scattering pattern are formed in a film, and the scattering pattern is formed above or below the optical waveguide with respect to a direction perpendicular to a top surface of the film.

2. The display device of claim 1, wherein the light source module is an LD, an LED, or a lamp emitting a white light.

3. The display device of claim 1, wherein each of the channels further comprises an input means for mixing the optical signals having the different wavelengths generated in the light source module and inputting the mixed optical signals in the optical waveguide of the each channel.

4. The display device of claim 3, wherein the input means is an optical coupler.

5. The display device of claim 1, wherein the driving module includes an electrical PCB that has a driving device for controlling the generation of the optical signals and the strength of the generated optical signals.

6. The display device of claim 1, wherein each optical waveguide is formed of a material having a higher optical refractive index than that of the film.

7. The display device of claim 1, where each optical waveguide is configured to transfer the generated optical signals without loss.

8. A display device, comprising:

a plurality of display layers, each display layer having a plurality of channels, each of the channels including:

a light source module configured to generate optical signals having different wavelengths;

a driving module in electrical connection with the light source, the driving module being configured to control the generation of the optical signals in the light source module and strength of the generated optical signals;

an optical waveguide configured to transfer the generated optical signals from the light source module; and a scattering pattern configured to scatter the optical signals transferred thereto from the light source module through the optical waveguide, wherein the optical waveguide and the scattering pattern are formed in a film, and the scattering pattern is formed above or below the optical waveguide with respect to a direction perpendicular to a top surface of the film.

* * * * *